US006131496A

United States Patent [19]

Schaede

[11] Patent Number: 6,131,496

[45] **Date of Patent: *Oct. 17, 2000**

[54] SHEET PROCESSING MACHINE WITH A CHAIN CONVEYOR

[75] Inventor: Johannes Georg Schaede, Würzburg, Germany

[73] Assignee: Koenig & Bauer-Albert Aktiengesellschaft, Wurzburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/954,853

[22] Filed: Oct. 21, 1997

[30] Foreign Application Priority Data

Oct. 21, 1996 [DE] Germany ..... 196 43 409
Dec. 20, 1996 [DE] Germany ..... 196 53 247

[51] Int. Cl.[7] ..... B26D 1/56; B23D 25/12

[52] U.S. Cl. ..... 83/151; 83/287; 83/341; 83/311; 83/349

[58] Field of Search ..... 83/408, 151, 435.2, 83/152, 154, 349, 341, 342, 370, 311, 312, 287, 288, 289, 295, 298, 323, 324, 325, 313, 409, 409.1

[56] References Cited

U.S. PATENT DOCUMENTS

| | | | |
|---|---|---|---|
| Re. 35,495 | 4/1997 | Bolza-Schuenemann | 101/232 |
| 1,356,900 | 10/1920 | Barber | 83/154 |
| 2,104,578 | 1/1938 | Barber | 271/182 |
| 2,208,350 | 7/1940 | Ungar | 83/298 |
| 2,659,437 | 11/1953 | Huck | 83/154 |
| 3,029,675 | 4/1962 | Alexander et al. | 83/298 |
| 3,401,585 | 9/1968 | Schmermund | 83/341 |
| 3,855,891 | 12/1974 | Young | 83/582 |
| 3,869,950 | 3/1975 | Serra | 83/349 |
| 3,924,848 | 12/1975 | Murakami | 271/10 |
| 4,090,118 | 5/1978 | Smith, Jr. | 83/295 |
| 4,267,752 | 5/1981 | Byrt et al. | 83/311 |
| 4,385,537 | 5/1983 | Wolf | 83/152 |
| 4,402,240 | 9/1983 | Moyer | 83/298 |
| 4,466,320 | 8/1984 | Tokuno | 83/325 |
| 4,497,229 | 2/1985 | Carrington et al. | 83/298 |
| 4,618,391 | 10/1986 | Torti et al. | 83/298 |
| 4,784,318 | 11/1988 | Bay | 83/408 |
| 4,934,228 | 6/1990 | Bolton et al. | 83/370 |
| 5,056,235 | 10/1991 | Thomas | 33/503 |
| 5,241,884 | 9/1993 | Smithe et al. | 83/312 |
| 5,329,852 | 7/1994 | Bolza-Schuenemann | 101/237 |
| 5,346,195 | 9/1994 | Heimann et al. | 83/311 |
| 5,400,582 | 3/1995 | Hartmeier et al. | 57/264 |
| 5,584,241 | 12/1996 | Yuasa | 101/230 |
| 5,640,908 | 6/1997 | Schaede | 101/484 |

FOREIGN PATENT DOCUMENTS

| | | | |
|---|---|---|---|
| 2245204 | 4/1975 | France | 83/152 |
| 3743530 | 7/1989 | Germany | 83/349 |
| 3834979 | 4/1990 | Germany | 83/349 |

*Primary Examiner*—Kenneth E. Peterson
*Assistant Examiner*—Stephen Choi
*Attorney, Agent, or Firm*—Jones, Tullar & Cooper, PC

[57] ABSTRACT

A sheet processing machine utilizes chain conveyors, each of which are provided with a plurality of chain gripper devices, to convey sheets. As each sheet is conveyed, it is cut by a transverse cutting device and is inspected. Each cut and inspected sheet may then be separated into several partial sheets which are then conveyed independently of each other to selectable stacks in a sheet delivery system.

4 Claims, 4 Drawing Sheets

SHEET PROCESSING MACHINE WITH A CHAIN CONVEYOR

FIELD OF THE INVENTION

The present invention is directed generally to a sheet processing machine with a chain conveyor. More specifically, the present invention is directed to a sheet processing machine with a chain conveyor and chain gripper systems. Most particularly, the present invention is directed to a sheet processing machine with a chain conveyor and chain gripper systems for transporting and cutting sheets. The sheets are conveyed by the chain conveyors from a supply or feed stack, past several inspection devices and through at least one transverse cutting assembly. As the sheets are conveyed, they are inspected for defects and for proper printing. Each sheet is cut at least once in a direction transverse to its path of travel. The cut and inspected sheets are delivered to selected ones of a plurality of sheet stacks.

DESCRIPTION OF THE PRIOR ART

Sheets of material, such as paper, are often printed with a plurality of similar images or objects. Once the sheets have been printed, they are then cut or divided into a plurality of partial sheets, each of which may include a single one of the plurality of images or objects. Typically, the cutting of the printed sheets into smaller partial sheets is accomplished in a separate operation.

In the German Published Examined Patent Application DE-AS-1044589 there is disclosed a transverse cutting device for paper webs. A belt system is used to transport sheets that have been cut from the web. This belt system is connected downstream of the transverse cutting device.

A device that is usable to prepare cut-outs for folding boxes is set forth in German Patent Publication DE 36 17 916 A1. In this device, rectangular cut-outs are fed in a timed sequence by a chain conveyor to a stamping station.

The German Patent Publication DE 42 38 387 A1 discloses a cutting register regulating device which is situated at a transverse cutter arrangement for a rotary printing press. A rotating cutting cylinder, which cooperates with a fixed, opposed cutter, is provided at this cutting register regulating device.

It will be seen that a need exists for a sheet processing machine with a chain conveyor which overcomes the limitations of the prior art devices. The present invention provides such a device and is a substantial advance in the art.

SUMMARY OF THE INVENTION

It is an object of the present invention to provide a sheet processing machine with a chain conveyor.

Another object of the present invention is to provide a sheet processing machine with a chain conveyor and chain gripper system.

A further object of the present invention is to provide a sheet processing machine with a chain conveyor for transporting and cutting sheets.

Still another object of the present invention is to provide a sheet processing machine with a chain conveyor and a transverse cutting device.

Even yet a further object of the present invention is to provide a sheet processing machine with a chain conveyor and transverse cutting and inspecting devices.

As will be discussed in detail in the description of the preferred embodiment which is presented subsequently, the sheet processing machine with chain conveyors in accordance with the present invention utilizes chain gripper systems having chain gripper devices to transport sheets from a sheet supply stack to a plurality of cut, partial sheet receiving stacks. As the sheets are transported by the chain conveyors, they are inspected for flaws in the sheets themselves, as well as in the printing applied to the sheets. Each sheet passes through at least one transverse cutting device while it is being conveyed by the chain conveyor. The sheet may also be divided into a plurality of partial sheets by the operation of additional transverse and longitudinal cutters which are situated along the path of travel of the sheet, as it is moved by the chain conveyors. The resultant partial sheets can be inspected and delivered to selected stacks of cut sheets depending on their quality.

The advantages which can be attained by the sheet processing machine with a chain conveyor of the present invention lie, in particular, in that transverse cutting from the start to the end of a sheet can take place in a sheet processing machine without manual intervention. It is also possible, by means of integrated inspection devices, to control the print quality itself, as well as to control the cutting register in the sheet processing machine. For example, it is possible to control the fronts and backs of sheets printed in obverse and reverse printing simultaneously. A simple cutting register adjustment is possible because of the cooperation between the transverse cutting devices with a chain conveyor, which can be advantageously performed by a position-controlled electric motor driving a cutting cylinder.

A longitudinal cutting device is associated with a processing cylinder of the sheet processing machine, so that the sheet is cut "inline" into two or more partial sheets. The sheets can be deposited on stacks. The particular stack for each sheet can be selected by use of an inspection device, so that, for example, sorted stacks of "good" and rejected sheets are formed. This has the advantage that in case of a defective partial sheet, the entire sheet need not be discarded since the defective partial sheet can be separated from the rest of the sheet.

All sides of a sheet are cut by means of this sheet processing machine. All cuts are made to properly locate the obverse and reverse printing on the partial sheets, and are controlled by the inspection devices and the sheets are deposited on selectable stacks.

This sheet processing machine with a chain conveyor performs a multitude of processing operations "inline", which results in a production increase and a reduction of manual labor. In addition, the quality of the products made in this way is increased. The sheet processing machine in accordance with the present invention overcomes the limitations of the prior art and is a substantial advance in the art.

BRIEF DESCRIPTION OF THE DRAWINGS

While the novel features of the sheet processing machine with a chain conveyor in accordance with the present invention are set forth with particularity in the appended claims, a full and complete understanding of the invention may be had by referring to the detailed description of the preferred embodiment, which is presented subsequent and as illustrated in the accompanying drawings, in which:

DETAILED DESCRIPTION OF THE PREFERRED EMBODIMENT

Figure 1:
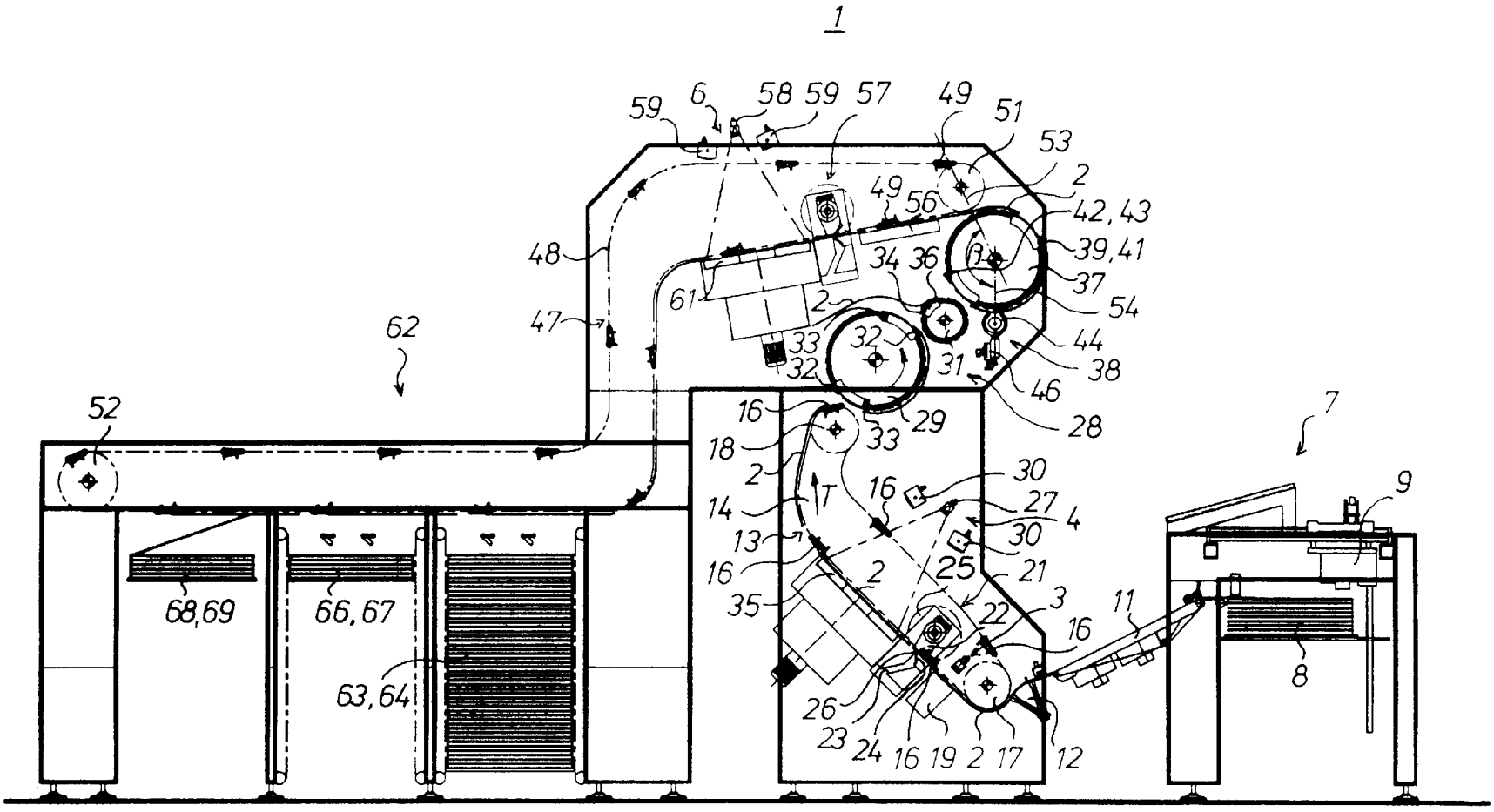
FIG. 1 is a schematic side elevation view of a sheet processing machine with a chain conveyor in accordance with the present invention.

Referring initially primarily to FIG. 1, there may be seen, generally at 1, a sheet processing machine with a chain conveyor in accordance with the present invention. This sheet processing machine 1 is utilized to accomplish the transverse and longitudinal cutting of sheets 2 and has integrated inspection devices 3, 4, 6. The sheets 2 preferably are printed sheets of paper, for example stocks or bonds. This sheet processing machine with a chain conveyor 1 is constructed as will now be discussed in detail.

A sheet feeder 7 essentially has a sheet feed stack 8, a sheet separation device 9 and a feed table 11. An installation 12 follows this sheet feeder 7, as may be embodied as a swing feeder, for example. A first chain conveyor 13 cooperates with this swing feeder 12. This first chain conveyor 13 has a pair of laterally or axially spaced circulating chains 14, to which axially extending chain gripper devices 16 are attached. The two spaced chains 14 are reversed by passage around a first, 17, and a second chain wheel shaft 18. The two spaced chains 14 extend at least partially along a straight line between the first, 17, and the second chain wheel shaft 18. Viewed in the transport direction T, the first inspection device 3 is disposed downstream of the first chain wheel shaft 17. This first inspection device 3 has a suction box 19, whose work surface facing the chain gripper devices 16 is made to be at least partially transparent. Illuminating devices, not represented, are disposed underneath this transparent work surface of the suction box 19 of the first inspection device 3.

A first transverse cutting device, generally at 21, is placed downstream of this suction box 19. This first transverse cutting device 21 has a rotating cutting cylinder 22 and a fixed opposed cutter 24, which may be fastened to a cross bar 23. The cutting cylinder 22 is provided with at least one axially extending depression or recess on its peripheral surface, and, into which a passing chain gripper device 16 of the first chain conveyor 13 can dip. A width of the depression in the circumferential direction of the cutting cylinder 22 is made larger than a width required by the chain gripper device 16, so that cooperating chain gripper devices 16 and cutting cylinder 22 can be phase-shifted in respect to each other for adjusting the cutting register. Similar cylinders with such axially extending peripheral depressions or recesses for receipt of the chain gripper devices are shown at 29 and 37 in FIGS. 1 and 4. In the present arrangement, rotating arms are provided on both sides of the cutting cylinder 22 and between which an axially extending cross bar which carries a cutter 26 is disposed.

The cutting cylinder 22 has a drive, which can be phase-shifted in respect to the chain conveyor 13. In the present invention this cutting cylinder drive is advantageously embodied as a separate, position-controlled electric motor 25 that is attached to or connected to the end of the cutting cylinder 22.

The opposed fixed cutter 24, which cooperates with the cutting cylinder 22, is arranged to be placed slightly angled or inclined with respect to the axis of rotation of the cutting cylinder 22. Thus, the opposed cutter 24 forms an opening angle with respect to the transport direction T, which is not equal to 90°, and is, for example 89°. This results, for example, in an angle of inclination of 1° of the opposed cutter 24 in respect to the axis of rotation of the cutting cylinder 22. The opposed cutter 24 furthermore is slightly turned around its longitudinal axis, i.e. the opposed cutter 24 has a slight twist. The electrical drive of the cutting cylinder 22 follows the speed of the chain conveyor 13 at the identical circumferential speed, so that the result is that an exactly right-angled cut of the sheet 2 is created by the twist and the superimposed transport speed. The axially extending cutter 26 of the cutting cylinder 22 is slightly inclined with respect to the axis of rotation of the cutting cylinder 22 and has a twist in the longitudinal direction. The cutter 22 and the opposed cutter 24 are matched to each other.

A rotating opposed cylinder is also possible in place of the fixed opposed cutter 24 and, for example, could have an opposed cutter 24 for performing a scissors cut, or could have an opposed bar. It is also possible to embody the cutter 26 and the opposed cutter 24 parallel with the axis of rotation of the cutting cylinder 22 and without twists. The cutting cylinder 22 or the opposed cylinder can also have a plurality of cutters 26. The arrangement of the cutter 26 and the opposed cutter 24 will be understood as being selected to insure that the end of each sheet 2 will be cut square even though the sheet is moving in the transport direction T while undergoing cutting.

A second inspection device 4 is arranged downstream, in the travel direction T, of this first transverse cutting device 21 in the area of the chain conveyor 13. This second inspection device 4 essentially consists of a sensor 27, illuminating devices 30 and a suction box 35.

A reversing device 28 follows the first chain conveyor 13. In the present invention, this reversing device 28 essentially consists of a storage drum 29 and a reversing drum 31. The storage drum 29 has a "double" circumference and therefore is equipped with two controllable gripper systems 32, which are arranged offset from each other by 180°, and two suction systems 33 which are located opposite each other. A distance in the circumferential direction between the gripper systems 32 and suction systems 33 can be adjusted to the length of the sheets 2 to be transported. The suction systems 33 can be moved in both the circumferential and the axial direction.

The reversing drum 31 has two controllable gripper systems 34 and 36, which are located next to each other, and which are disposed to be pivotable around their longitudinal axes. The reversing drum 31 and the storage drum can be phase-shifted with respect to each other. It will be understood that a gripper system or device or a chain gripper system or device means a plurality of grippers arranged on a shaft which is pivotable about its longitudinal axis.

A cylinder 37, which may be, for example, a processing cylinder 37 with a cooperating longitudinal cutting device 38, is placed downstream of the reversing device 28. This processing cylinder 37 has, for example, at least a doubled circumference and is provided with four holding systems 39, 41, 42 and 43, which are controllable independently of each other and are embodied as gripper systems 39, 41, 42, 43, all as may be seen in FIGS. 4 and 5. These holding systems 39, 41, 42, 43 can also be embodied as suction devices. Two of these gripper systems 39 and 41 or 42 and 43 are each located in the axial direction, in relation to a center of the processing cylinder 37, approximately axially symmetrically next to each other in a cylinder depression and can be displaced relative to each other in the axial direction. In the present invention, one of the two gripper systems 39 or 42 located next to each other is arranged fixed in the axial direction, and the second gripper system 41 or 43, respectively is displaceable in respect to the first gripper system 39 or 42, for example by means of a cam 40 and cam rollers 45. However, both gripper systems pairs 39 and 41 or 42 and 43 can also be displaceable. A second pair of these gripper systems 42 and 43 is located, offset by 180°, opposite the first pair of two gripper systems 39 and 41 designed in this way. This means that in each pair of gripper systems 39 and 41 or 42 and 43 which are situated axially adjacent each other on the processing cylinder 37 that one of the gripper systems can be shifted circumferentially with respect to each other. Both can, if desired, be shiftable circumferentially with respect to each other. This shifting can be accomplished to effect proper register or spacing.

Figure 4:
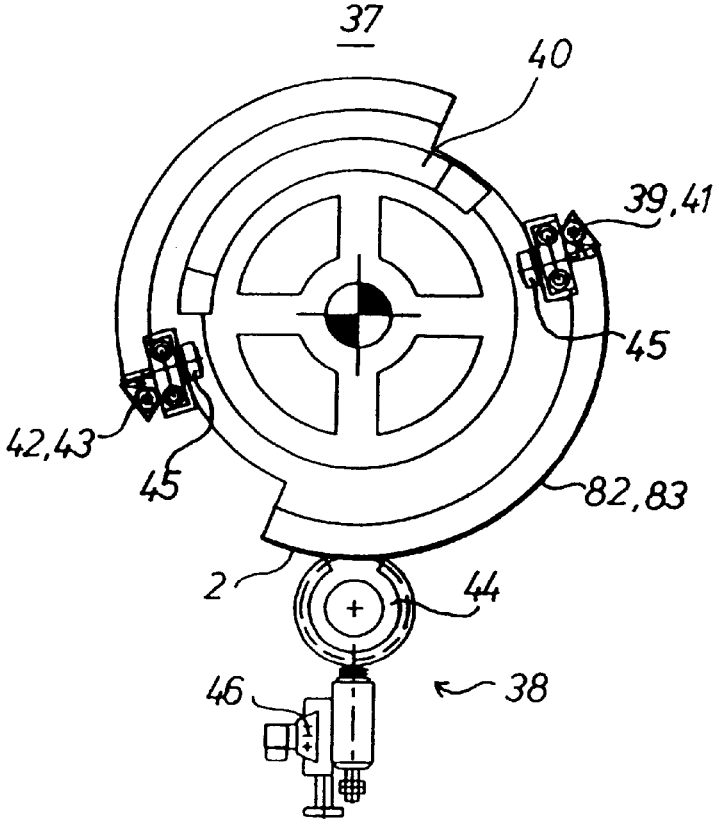
FIG. 4 is an enlarged, schematic side elevation view of a processing cylinder of the sheet processing machine shown in FIG. 1.
Figure 5:
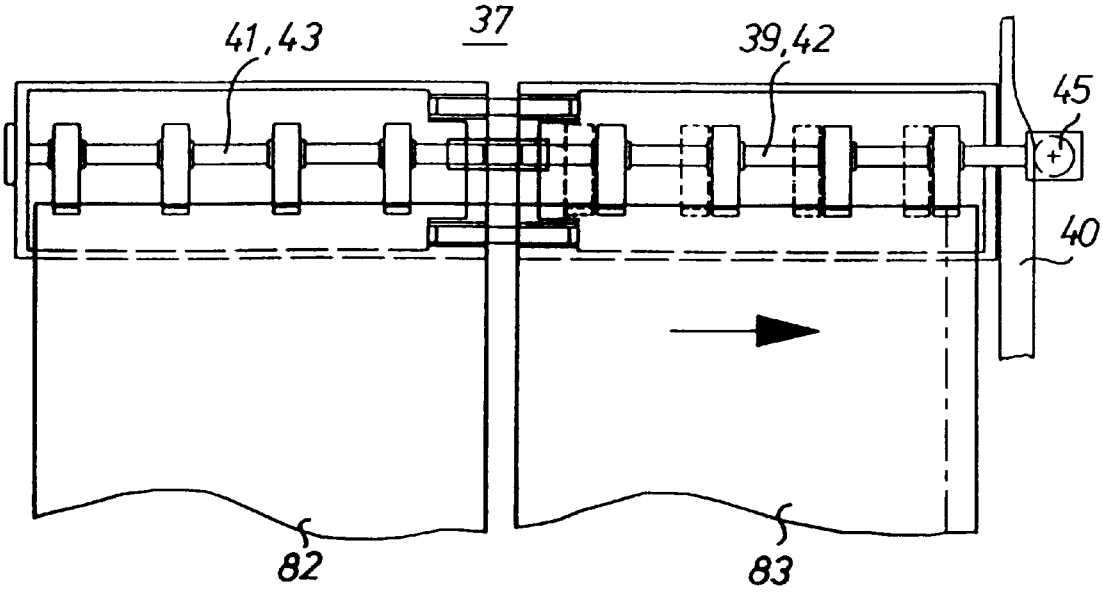
FIG. 5 is an enlarged, schematic top plan view of the processing cylinder shown in FIG. 4, which is a part of the sheet processing machine shown in FIG. 1.

The longitudinal cutting device 38 is also shown in FIG. 4 and has a plurality of cutting wheels 44 that are associated with the processing cylinder 37, and is disposed just downstream of the reversing drum 31 in the sheet transport direction T. In the present embodiment, this longitudinal cutting device 38 has an axially extending cross bar 46, on which three independently actuable and axially displaceable cutting wheels 44 are arranged. It will be understood that the surface of the processing cylinder 37 may be provided with circumferentially extending counter-cutting strips that cooperate with the cutting wheels 44.

A second chain conveyor 47, which is formed generally by two circulating chains 48, is arranged downstream of the processing cylinder 37. A plurality of chain gripper systems 49 are arranged on these chains 48. These chain gripper systems 49 each consist of two chain gripper devices which are located next to each other in the axial direction, which are arranged approximately symmetrically in relation to the machine center, and which can be actuated independently of each other. In place of the processing cylinder 37, it is also possible for the chain conveyor 47 to have chain gripper systems which can be moved in the axial direction in respect to each other. It is also possible for more than two gripper systems 39 and 41 or 42 and 43, for example any arbitrary number, to be provided and to be displaceable. In the case of three gripper systems arranged axially next to each other, it would be possible, for example, for the gripper system arranged in the center to be stationary in the axial direction, and for the two outer gripper systems to be movable away from the center one. The axial shiftability of the chain gripper system will allow for the lateral spacing of partial sheet segments, as will be discussed shortly, to be varied.

The two spaced chains 48 in the second chain conveyor 47 are reversed by a first and a second chain wheel shaft 51, 52. A centerline 53 through the chain wheel shaft 51 and the processing cylinder 37 forms an opening angle β of less than 180°, for example of 155°, with a centerline 54 through the processing cylinder 37 and the cutting wheels 44.

Figure 2:
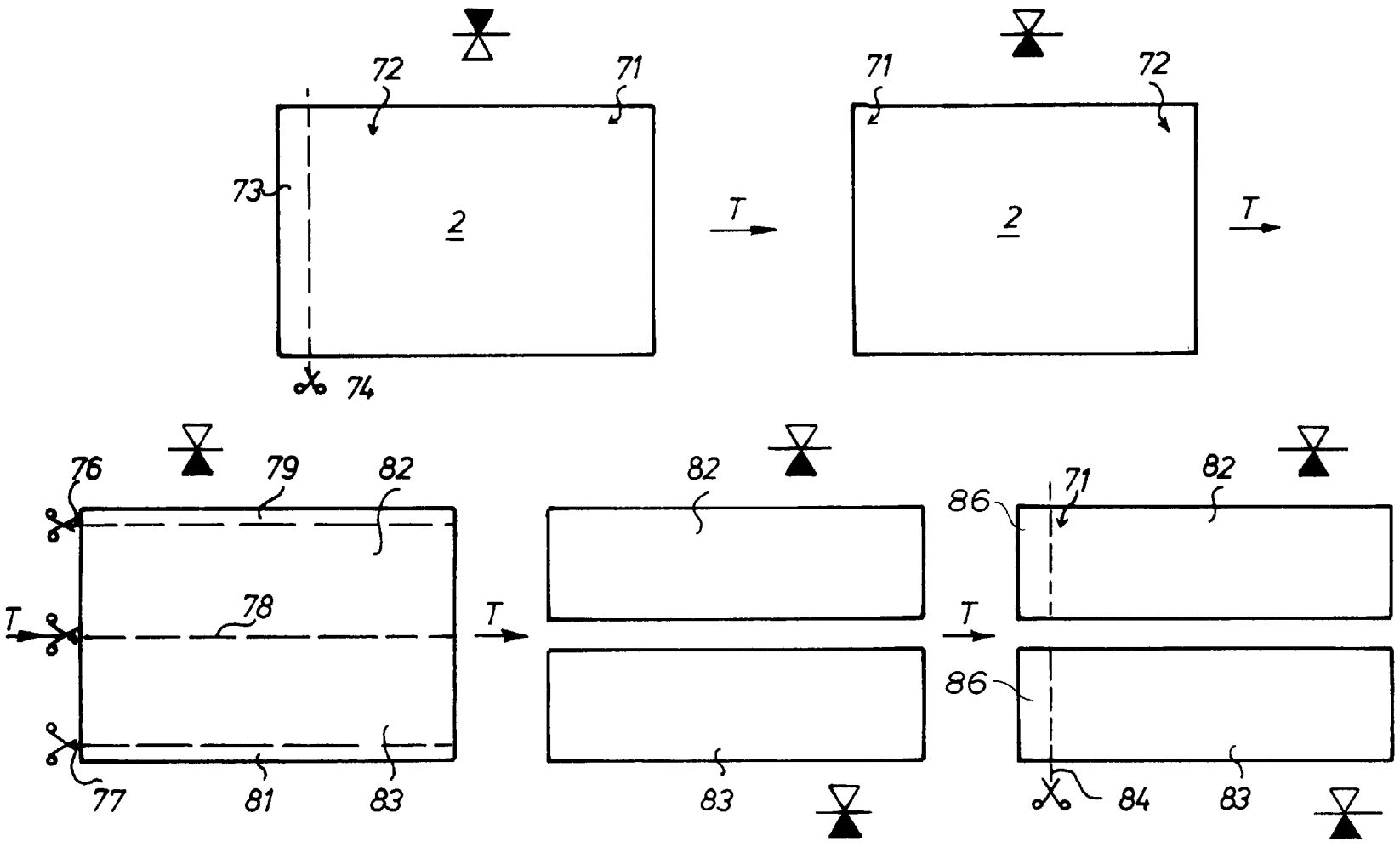
FIG. 2 is a schematic depiction of the processing steps accomplished on a sheet in the sheet processing machine.
Figure 3:
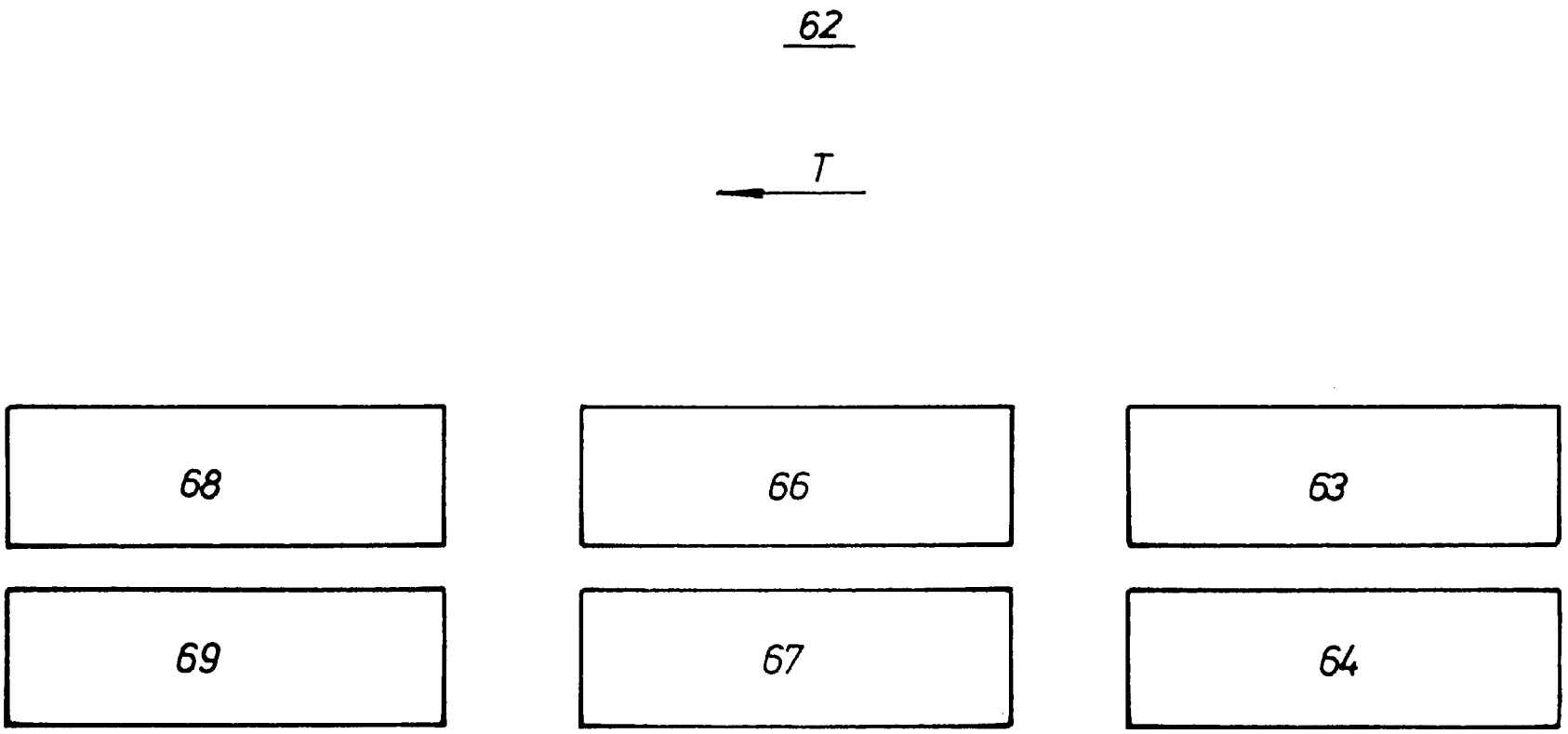
FIG. 3 is a schematic top plan view of a sheet delivery device of the sheet processing machine.

Downstream of this first chain wheel shaft 51, a suction box 56 is arranged in the path of the chain conveyor 47 and below the chain 48. A second transverse cutting device 57 follows this suction box 56, and is constructed the same as the first transverse cutting device 21. The two transverse cutting devices 21 and 57 are used for cutting the ends 71, 72 of the sheets 2 or the partial sheets 82, 83, as seen in FIG. 2. The third inspection device 6 with a sensor 58, illuminating devices 59, and a suction box 61, is arranged downstream of this second transverse cutting device 57.

Following the third inspection device 6 and in the sheet travel direction, a sheet delivery device 62 is located in the area of the second chain conveyor 47. This sheet delivery device 62 has six stacks 63, 64, 66 to 69, which are arranged next to each other in groups of two so that the resultant three pairs of stacks 63 and 64 or 66 and 67 or 68 and 69 are arranged behind each other. The stacks 63, 64 or 66, 67 of the first two pairs of stacks each have common lifting devices, so that each pair of stacks 63 and 64, or 66 and 67 is lifted or lowered together. Separate lifting devices are provided for the third pair of stacks 68 and 69 located next to each other, so that the two stacks 68 and 69, which form the third pair of stacks, can be lifted and lowered independently of each other.

The operation of the sheet processing machine with a chain conveyor 1, in accordance with the present invention will now be discussed in detail. Referring again initially to FIG. 1, a sheet 2, which may be, in particular, a sheet of paper printed on both the obverse and reverse sides, is conveyed from the feed stack 8 by the sheet separation device 9 to the feed table 11. The sheet 2 is grasped off this feed table 11 by the swing feeder 12 and is transferred to a first chain gripper system 16 in the area of the first chain wheel shaft 17 of the first chain conveyor 13. This chain gripper system 16 transports the sheet 2 along the "straight" portion of the first chain conveyor 13 to the first inspection device 3. The sheet 2 is checked in segments for damage, such as, for example tears and holes, by the first inspection device 3. The water mark of the sheet 2 is also inspected by use of transmitted light. In the process, the sheet 2 is conducted by the suction box 19, which is charged with suction air, of the first inspection device 3. The first chain gripper system 16 transports the sheet 2 through the transverse cutting device 21 to the second inspection station 4. There, the sheet 2 is aspirated in an area of a start 71 of the sheet 2, as seen in FIG. 2, by the suction box 35 of the second inspection device 4. An end 72 of the sheet 2 is still in the first transverse cutting device 21, in which a narrow, axially extending strip 73 is cut off its end 72. In the process, the transport speed of the first chain conveyor 13 and the circumferential speed of the first cutter 26 are matched to each other, so that the end 72 of the sheet 2 is cut at right angles in relation to the transport direction T.

This sheet 2, having a first cut 74, is now inspected by the second inspection device 4. In the process, a front side (obverse print side) of the sheet 2 and a new edge of the sheet 2 (cutting register) resulting from the cut end 72 is inspected.

Subsequently the chain gripper system 16 transfers the start 71 of this sheet 2 to a gripper system of the storage drum 29. This storage drum 29 transports the sheet 2 in the direction of the reversing drum 31. If now the end 72 of this sheet reaches the area of the suction systems 33 of the storage drum 29, the former aspirates the cut end 72. The suction systems 33 extend away, in an approximately arrow-shaped manner, from the center of the storage drum 29 and in this way tighten the sheet 2 in the circumferential direction as well as in the direction of lateral edges of the sheet 2.

The phase shift between the reversing drum 31 and the storage drum 29 is matched to the length of the sheet 2 to be processed. The storage drum 29 transports the start 71 of the sheet 2 through the gap between the reversing drum 31 and the storage drum 29 until the suction systems 33 reach this gap. The cut end 72 of the sheet 2 is grasped by the first gripper system 34 of the reversing drum 31 and is released by the suction systems 33 by turning off the vacuum. Following this, both gripper systems 34 and 36 of the reversing drum 31 pivot toward each other and the cut end 72 is transferred from the first gripper system 34 to the second gripper system 36. In their further course the gripper systems 34, 36 pivot back into their initial position. Grasped by the gripper system 36, the cut end 72 now is at the front in the transport direction T and the uncut start 71 is situated at the end.

The sheet 2 is now transferred from the reversing drum 31 to a pair of gripper systems 39 and 41 or 42 and 43 of the processing cylinder 37. The sheet 2 is then provided, in the longitudinal direction, i.e. in the transport direction T, with three cuts 76, 77, 78 on the processing cylinder 37. Narrow strips 79 and 81 are cut off the two longitudinal sides of the sheet 2 by the second and third cuts 76, 77. The gripper spacings and widths of the gripper systems 39 and 41 or 42 and 43 of the processing cylinder 37, and the width and position of the sheet 2 are matched to each other in such a way that the two cut-off strips 79, 81 are not grasped by the grippers. The fourth cut 78 separates the sheet 2 in the center into two partial sheets 82, 83. Here, too, there is no gripper in the area of the cut 78. These various cuts and partial sheets are shown most clearly in FIG. 2.

If these three longitudinal cuts 76, 77 and 78 have been completely made, even with the sheet 2 being of a maximum length, the two partial sheets 82, 83 are caused to be moved away from each other in the axial direction. To this end, in the present invention, a gripper system 41 or 43 or 39 or 42 performs a lift in the axial direction by means of a cam roller cooperating with a cam disk. Only after these two partial sheets 82, 83 have been moved axially or laterally away from each other will these two partial sheets 82, 83 be transferred, in a common transport direction or transport level, and in the area of the first chain wheel shaft 51, to a chain gripper system 49 of the second chain conveyor 47. The gripper system 41 or 43 of the processing cylinder 37 is moved back into an initial position before the next sheet 2 is transferred.

The two partial sheets 82 and 83 are conducted to the second transverse cutting device 57 by this chain gripper system 49. To smooth out each sheet 2, or partial sheet 82 or 83, it is aspirated along the suction box 56 located upstream of the transverse cutting device 57, and the end 72 of the partial sheets 82, 83 in the chain gripper system 49 are already conducted over the suction box 61 of the third inspection device 6. A strip 86 is now cut off the now trailing start 71 of the sheet 2, i.e. of the two separated partial sheets 82 and 83, at right angles in the axial direction in respect to the transport direction T by means of a fifth cut 84. The sheet 2 has now been cut on all sides and has been separated into two partial sheets 82, 83.

A back or reverse printed side of the sheet 2, i.e. the backs of the two partial sheets 82, 83, is now checked by the inspection device 6, together with the cut edges in the longitudinal direction. The now trailing start 71 of the sheet 2, i.e. the trailing ends, is cut in the axial direction, of the partial sheets 82, 83. The inspection devices 4 and 6 inspect the cutting register of the sheets 2, 83, 84, i.e. at least the position of a cut edge, preferably of all cut edges of the sheets 2, 82, 83, in respect to a reference marking, for example within an printed image. The entire sheets including the entire printed image are preferably inspected.

From the inspection device 6, the second chain conveyor 47 transports the partial sheets 82 and 83, which were cut on all sides and which have been inspected on both the front and back, to selected ones of the six stacks 63, 64, 66 to 69 of the sheet delivery device 62. There, the partial sheets 82 and 83 can be selectively deposited on one of the six stacks 63, 64, 66 to 69. In this case, the first four stacks 63, 64, 66, 67 preferably accept so-called "good" sheets, and the two last stacks 67, 68, arranged next to each other, receive the rejected sheets.

It is also possible to trim or cut apart printed webs, such as printed webs of material, in place of printed sheets 2, 82, 83, and to subsequently inspect them by means of one or several inspection devices 3, 4, 6. In this case, the cutting devices 21, 38 and 57 can be disposed in the area of a folding mechanism of a sheet-fed rotary printing press, for example. There a web is cut in the longitudinal direction, for example, into several partial webs and is subsequently cut into signatures in the transverse direction. In the process, the cutting register can be inspected after every cut or after the web has been completely into signatures.

The inspection devices 3, 4, 6 preferably contain one or several CCD flat cameras which inspect the sheet as a whole.

While a preferred embodiment of a sheet processing machine with a chain conveyor in accordance with the present invention has been set forth fully and completely hereinabove, it will be apparent to one of skill in the art that a number of changes in, for example, the type of printing done on the sheets, the type of printing presses used to accomplish the printing and the like could be made without departing from the true spirit and scope of the present invention, which is accordingly to be limited only by the following claims.

What is claimed is:

1. A sheet processing machine comprising:

a chain conveyor for transporting a plurality of sheets, each of said plurality of sheets having a leading end and a trailing end;

first and second laterally spaced circulating chains, said first and second circulating chains forming said chain conveyor;

a plurality of chain gripper systems carried by said chain conveyor, each of said chain gripper systems extending between said first and second laterally spaced circulating chains and engaging said leading end of one of said plurality of sheets and transporting each of said plurality of sheets in a sheet transport direction;

at least one transverse sheet cutting device cooperating with said chain conveyor, said transverse sheet cutting device including a rotating cutting cylinder with a cutter, said rotating cutting cylinder having a peripheral surface and being positioned between said first and second laterally spaced circulating chains and having an axis of rotation generally transverse to said direction of transport of said plurality of sheets by said chain conveyor, said cutter extending axially across said rotating cutting cylinder between said first and second laterally spaced circulating chains;

an axially extending depression in said peripheral surface of said rotating cutting cylinder, said axially extending depression receiving said chain gripper systems as said chain gripper systems pass through said transverse sheet cutting device, said axially extending depression having a width larger than a width required by said chain gripper systems;

an opposing cutter cooperating with said cutter on said rotating cutting cylinder, said cutter on said rotating cutting cylinder and said opposing cutter being inclined with respect to said axis of rotation of said rotating cutting cylinder, said cutter on said rotating cutting cylinder and said opposing cutter cooperating to cut a transverse strip off said trailing end of each of said plurality of sheets while each of said plurality of sheets is engaged by one of said chain gripper systems and is passing through said at least one transverse cutting device; and means to phase shift said rotating cutting cylinder with respect to said chain conveyor to adjust cutting register of said rotating cutting cylinder with respect to said chain conveyor, said means to phase shift said rotating cutting cylinder including a position controlled electric motor driving said rotating cutting cylinder.

2. The sheet processing machine of claim 1 further including a suction box disposed downstream, in said transport direction of said sheets from said at least one transverse cutting device.

3. The sheet processing machine of claim 1 further including a sheet inspection device disposed downstream, in said transport direction of said sheets from said at least one transverse cutting device.

4. The sheet processing machine of claim 1 further including a sheet inspection device including a suction box disposed downstream, in said transport direction of said sheets from said at least one transverse cutting device.

* * * * *